US007367210B2

(12) United States Patent
Nishibu

(10) Patent No.: US 7,367,210 B2
(45) Date of Patent: May 6, 2008

(54) PUNCH PRESS AND DEBURRING DEVICE FOR THE PUNCH PRESS

(75) Inventor: Hidehisa Nishibu, Kakamigahara (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 109 days.

(21) Appl. No.: 11/211,620

(22) Filed: Aug. 26, 2005

(65) Prior Publication Data

US 2006/0042341 A1 Mar. 2, 2006

(30) Foreign Application Priority Data

Aug. 30, 2004 (JP) ..... 2004-249553
Oct. 19, 2004 (JP) ..... 2004-303745

(51) Int. Cl.
*B21D 28/16* (2006.01)

(52) U.S. Cl. ..... 72/335; 72/75; 29/90.01

(58) Field of Classification Search ..... 72/70, 72/75, 335, 416; 29/90.01
See application file for complete search history.

(56) References Cited

U.S. PATENT DOCUMENTS

| | | | | |
|---|---|---|---|---|
| 3,478,558 | A * | 11/1969 | Miller et al. | 72/199 |
| 4,089,204 | A * | 5/1978 | Neilsen | 72/412 |
| 6,131,430 | A | 10/2000 | Schneider et al. | |
| 7,168,364 | B2 * | 1/2007 | Schneider | 101/3.1 |
| 2001/0042453 | A1 * | 11/2001 | Schneider | 101/28 |

FOREIGN PATENT DOCUMENTS

JP 3469929 9/2003

OTHER PUBLICATIONS

Utility Model Abstracts of Japan, Publication No. H3-42320, published on Apr. 22, 1991.

* cited by examiner

*Primary Examiner*—Daniel C Crane
(74) *Attorney, Agent, or Firm*—Westerman, Hattori, Daniels & Adrian, LLP.

(57) ABSTRACT

The present invention provides a deburring device for a punch press which can remove burrs produced along a slot or a cut portion formed in a plate material by punching or cutting using a punch press so that the removal is carried out as a process with the same punch press. A deburring device 6 for a punch press has an upper tool 7 and a lower tool 8 arranged opposite each other. The upper and lower tools 7, 8 each have a ball holding member 22, 32, respectively, and a ball 23, 33, respectively, rotatably supported by the ball holding member and projecting from a surface of the ball holding member 22, 32 toward an opposite surface of the opposite ball holding member 32, 22. Each of the upper and lower balls 23, 33 has a diameter larger than the width of the slot A, in its portion projecting from the ball holding member 22, 32, respectively, the slot A being formed in the plate material W so as to extend across the plane. The plate material W moves with the vertical pair of balls 23, 33 partly fitted into the slot A and with the plate material W sandwiched between the upper and lower balls 23, 33 to continuously remove burrs (a) produced along a longitudinal direction of the slot A. The deburring device 6 continuously removes not only the burrs produced along the slot A but also those produced along a cut portion in the plate material W as described above.

4 Claims, 10 Drawing Sheets

PUNCH PRESS AND DEBURRING DEVICE FOR THE PUNCH PRESS

FIELD OF THE INVENTION

The present invention relates to a deburring device and a deburring method for a punch press which removes burrs produced on a plate material as a result punching with a punch press, as well as the punch press.

BACKGROUND OF THE INVENTION

When a plate material is punched using a punch press, burrs are always produced on the back surface of a punched portion of the plate material owing to a die clearance. To remove the burrs produced on the back surface of the plate material, the conventional art requires manual sanding of the plate material during a post-process or execution of a deburring step using a deburring machine. The need for the deburring step is a factor delaying the delivery of machined products and increasing costs.

The techniques described below have been proposed which carry out deburring using a punch press instead of the deburring executed during the post-process. One of the techniques involves providing a polishing member such as a buff sheet on a bottom surface of a punch tool or on a top surface of a die tool and rotating the tools with a punch hole portion of a plate material sandwiched between these tools to remove the burrs from the plate material (The Japanese Patent No. 3469929). Another technique involves providing a ball on the bottom surface of the punch tool or on the top surface of the die tool so that the ball can roll freely and sandwiching the punch hole portion of the plate material between these tools under pressure to remove the burrs from the plate material (The Unexamined Japanese Utility Model Application Publication (Jikkai-Hei) No. 3-42320).

Although not applied to deburring of the plate material, another technique provides balls on the bottom surface of the punch tool or on the top surface of the die tool and sandwiches the plate material between these tools to roll the plate material (U.S. Pat. No. 6,131,430 (PCT National Publication No. 2003-527965)).

The method in the Japanese Patent No. 3469929 provides the polishing member such as a buff sheet on the bottom surface of the punch tool or on the top surface of the die tool and rotates the tools with the plate material sandwiched between these tools. However, this method is effective on a thin plate material but does not produce a deburring effect on a thicker plate material. Further, the method in the Unexamined Japanese Utility Model Application Publication (Jikkai-Hei) No. 3-42320 provides the ball on the bottom surface of the punch tool or on the top surface of the die tool so that the ball can roll freely and sandwiches the punch hole portion of the plate material between these tools under pressure. However, this method is effective on a round punch hole but cannot carry out deburring on a slot.

SUMMARY OF THE INVENTION

It is an object of the present invention to provide a deburring device and a deburring method for a punch press which can remove burrs from a cut portion of a plate material which has been formed by punching the plate material using the punch press so that the removal is carried out as a process with the same punch press.

It is another object of the present invention to provide durability for balls serving as deburring tools without damaging the balls.

It is yet another object of the present invention to a deburring method and a bunch press which make it possible to remove burrs produced in the cut portion of the plate material as a result of the formation of a hole in the plate material by punching so that the removal is carried out as a process with the same punch press.

A deburring device for a punch press according to the present invention is used for the punch press and has an upper tool and a lower tool arranged opposite each other. The upper and lower tools each have a ball holding member and a ball rotatably supported by the ball holding member and projecting from a surface of the ball holding member toward an opposite surface of the opposite ball holding member. With the deburring device, a plate material moves while being sandwiched between the upper and lower balls to continuously remove burrs produced along a longitudinal direction of a slot formed in the plate material.

The deburring device configured as described above moves the plate material, while sandwiching the plate material between the upper and lower balls. The burrs are gradually crushed by the balls portion by portion in a longitudinal direction. It is thus possible to continuously remove the burrs lying along the longitudinal direction of the slot. The upper and lower balls are rotatably supported. Accordingly, the balls are freely rotated by moving the plate material.

Consequently, the plate material can be smoothly moved. In this case, the balls press not only the bottom surface of the plate material, from which the burrs project, but also its top surface. This allows continuous deburring to be reliably and smoothly carried out. It is thus possible to continuously remove the burrs produced along the slot formed in the plate material as a result of punching with the punch press so that the removal is carried out as a process with the same punch press.

The deburring device can be used to simultaneously deburr the opposite side edges of the slot in the plate material along the longitudinal direction of the slot. The deburring device can also be used to deburr the edges of a slot or opening that has a width larger than the ball diameter or to deburr the machined outer periphery of a plate material product.

The configuration described below can be used to simultaneously deburr the opposite side edges of the slot along the longitudinal direction of the slot. Each of the upper and lower balls has a diameter larger than the width of the slot, in its portion projecting from the ball holding member. The plate material moves with the vertical pair of balls partly fitted into the slot and with the plate material sandwiched between the upper and lower balls to continuously remove burrs produced at the opposite side edges of the slot along the longitudinal direction of the slot.

In the present invention, burrs projecting downward from the plate material may be removed by pressing the balls against the burrs to plastically deform the burrs toward the inside of the slot. This configuration can provide the balls with durability without damaging the balls.

The present invention provides a deburring method burrs produced along opening edges of a slot formed in a plate material so as to extend across a plane. The deburring method is characterized by using a punch press and an upper and lower tools for the punch press each having a ball holding member and a ball rotatably supported by the ball holding member, and in that a plate material is moved along a longitudinal direction of the slot while being sandwiched between the upper and lower balls to continuously remove burrs produced along the longitudinal direction of the slot formed in the plate material. This method can continuously remove the burrs produced along the slot formed in the plate material as a result of punching with the punch press so that the removal is carried out as a process with the same punch press and can be smoothly executed, even if the slot is formed to have an acute angle.

A punch press according to the present invention comprises punching means for punching a plate material, a plate material feeding mechanism which feeds the plate material to a punch position in the punching means, an upper tool support on which a plurality of upper tools can be installed, a lower tool support on which a plurality of lower tools corresponding to the upper tools can be installed, tool indexing means for indexing the upper and lower tools on the upper and lower tool supports to the punch position in the punching means, and machining control means for controlling the punching means, plate material feeding mechanism, and tool indexing means. At least one of the upper tools and at least one of the lower tools are a punch tool and a die tool used to form a hole in the plate material. At least one other upper tool and at least one other lower tool are an upper and lower tools for a deburring device. The upper and lower tools each having a ball holding member and a ball rotatably supported by the ball holding member and projecting from a surface of the ball holding member toward an opposite surface of the opposite ball holding member. The machining control means uses the tool indexing means to index the punch tool and die tool, using the punching means to form a slot in the plate material which extends across a plane, while using the plate material feeding means to move the plate material, then using the tool indexing means to index the deburring device, and using the plate material feeding means to move the plate material along the slot with the plate material sandwiched between the upper and lower balls using the punching means, to continuously remove burrs produced along opening edges of the slot formed in the plate material. The punch press configured as described above enables the removal of the burrs formed along the slot punched in the plate material so that the removal is carried out as a process with the same punch process.

In the above description, the present invention is used to remove the burrs produced along the longitudinal direction of the slot. The deburring device for the punch press according to the present invention can also be used to continuously remove burrs produced along a cut portion formed in the plate material. That is, the present invention may provide a deburring device used for a punch press, the tool having an upper tool and a lower tool arranged opposite each other, the upper and lower tools each having a ball holding member and a ball rotatably supported by the ball holding member and projecting from a surface of the ball holding member toward an opposite surface of the opposite ball holding member, wherein a plate material moves while being sandwiched between the upper and lower balls to continuously remove burrs produced along a cut portion formed on the plate material. A punch press may be used to cut a plate material by nibbling or other continuous machining of punch holes. Even if burrs are removed which have been produced along the cut portion of the plate material formed by the above cutting operation, the deburring device according to the present invention moves the plate material while sandwiching it between the upper and lower balls. Thus, the burrs are gradually crushed portion by portion in the longitudinal direction. The burrs lying along the cut portion can be continuously removed.

The deburring device for the punch press according to the present invention is used for the punch press and has the upper tool and lower tool arranged opposite each other, and the upper and lower tools each have the ball holding member and the ball rotatably supported by the ball holding member and projecting from the surface of the ball holding member toward the opposite surface of the opposite ball holding member. With the deburring device, the plate material moves while being sandwiched between the upper and lower balls to continuously remove the burrs produced along the longitudinal direction of the slot formed in the plate material. It is thus possible to continuously and smoothly remove the burrs produced along the slot formed in the plate material as a result of punching with the punch press that the removal is carried out as a process with the same punch press. The configuration described below enables the simultaneous removal of the burrs produced at the opposite side edges of the slot along the longitudinal direction of the slot. Each of the upper and lower balls has the diameter larger than the width of the slot, in its portion projecting from the ball holding member. The plate material moves with the vertical pair of balls partly fitted into the slot and with the plate material sandwiched between the upper and lower balls. The configuration described below can provide the balls with durability without damaging the balls. The deburring device removes burrs projecting downward from the plate material by pressing the balls against the burrs to plastically deform the burrs toward the inside of the slot.

The present invention provides the deburring method the burrs produced along the opening edges of the slot formed in the plate material so as to extend across the plane. The method uses the punch press and the upper and lower tools for the punch press each having the ball holding member and the ball rotatably supported by the ball holding member. The plate material is moved along the longitudinal direction of the slot while being sandwiched between the upper and lower balls to continuously remove the burrs produced along the longitudinal direction of the slot formed in the plate material. This method can continuously and smoothly remove the burrs produced along the slot formed in the plate material as a result of punching with the punch press so that the removal is carried out as a process with the same punch press, even if the slot is inclined at an acute angle. It is thus possible to continuously and smoothly remove the burrs produced along the slot formed in the plate material as a result of punching with the punch press so that the removal is carried out as a process with the same punch press.

According to the punch press of the present invention, after the slot is formed in the plate material by punching the plate material, the burrs produced along the slot can be removed so that the removal is carried out as a process with the same punch press.

The present invention provides another deburring device used for a punch press, the device having the upper tool and lower tool arranged opposite each other, the upper and lower tools each having the ball holding member and the ball rotatably supported by the ball holding member and projecting from the surface of the ball holding member toward the opposite surface of the opposite ball holding member. The plate material moves while being sandwiched between the upper and lower balls to continuously remove the burrs produced along the cut portion formed on the plate material. It is thus possible to continuously and smoothly remove the burrs produced in the cut portion formed by, for example, continuous machining with the punch press so that the removal is carried out as a process with the same punch press.

DETAILED DESCRIPTION OF THE PREFERRED EMBODIMENTS

Figure 1:
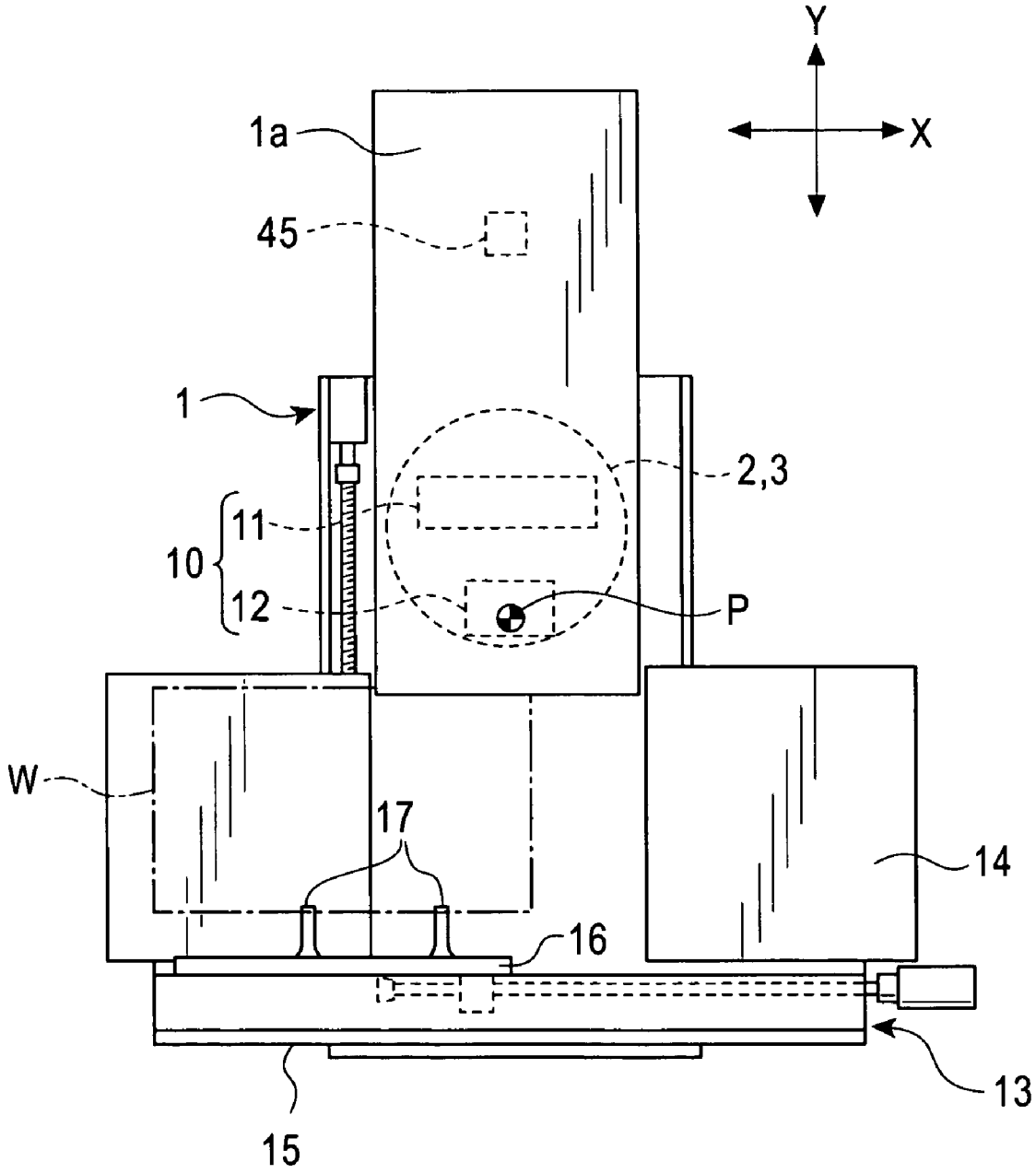
FIG. 1 is a plan view schematically showing the configuration of a punch press comprising a deburring device according to one embodiment of the present invention.
Figure 2:
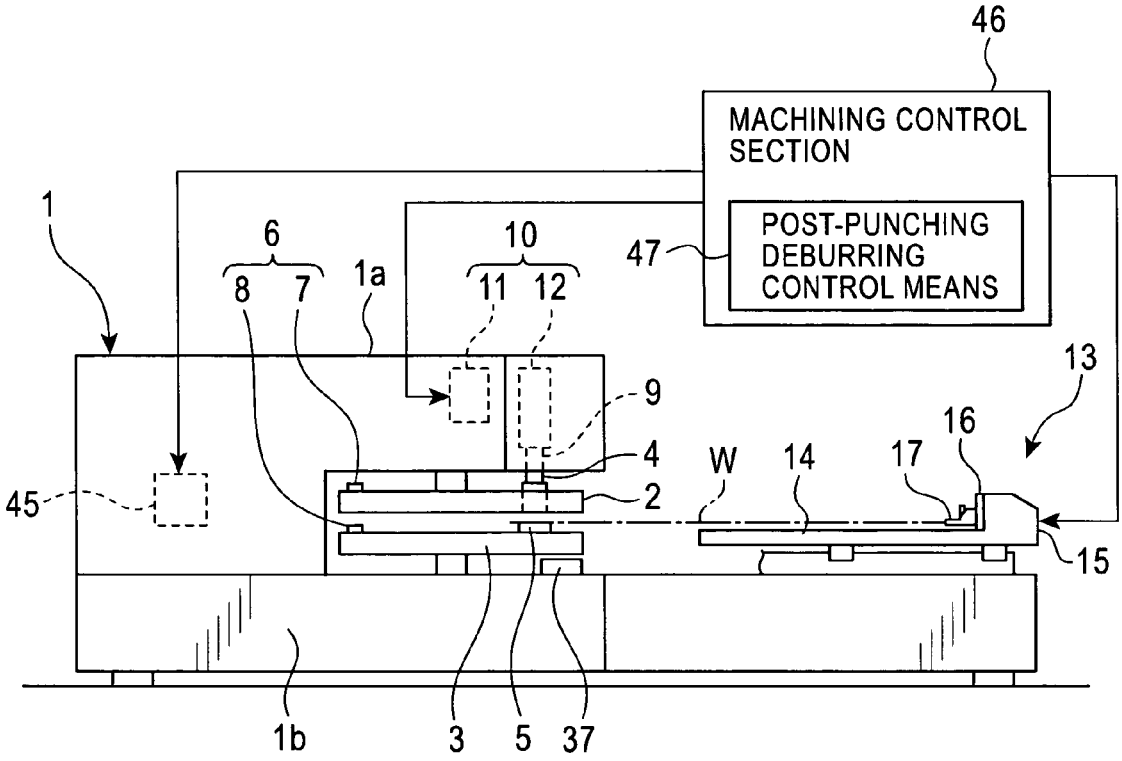
FIG. 2 is a side view schematically showing the punch press.

A first embodiment of the present invention will be described with reference to FIGS. 1 to 8. FIG. 1 is a plan view schematically showing the configuration of a punch press comprising a deburring device according to the embodiment. FIG. 2 is a side view of this configuration.

In the punch press, an upper and lower turrets 2, 3 serving as tool supports are supported on an upper frame portion 1*a* and lower frame portion 1*b* of a frame 1 so that the turrets 2, 3 can rotate around a concentric vertical axis. The following components are arranged on the upper and lower turrets 2, 3 in a circumferential direction: a plurality of punch tools 4 and die tools 5, and an upper tool 7 and a lower tool 8 of a deburring device 6. The upper and lower tools 7, 8 of the deburring device 6 may be provided in only one area or several types of upper and lower tools 7, 8 may be provided in a plurality of areas. Each punch tool 4 and the upper tool 7 of the deburring device 6 are indexed to a punch position P and then drivingly raised or lowered using a ram 9. The ram 9 is supported by the upper frame portion 1*a* via a guide member so that the ram 9 can be raised and lowered. The punching means 10 drivingly raises and lowers the ram 9. The punching means 10 is machining means for punching a plate material W.

With the upper and lower turrets 2, 3, tool indexing means 45 installed in the frame 1 indexes a desired tool to the punch position P. The tool indexing means 45 synchronously rotates the upper and lower turrets 2, 3 via a transmitting system such as a chain using, for example, a common motor (not shown in the drawings). The punching means 10 is composed of a servo motor 11 and a motion converting mechanism 12 that converts rotation of the servo motor into linear motion.

A plate material feeding mechanism 13 is means for feeding an arbitrary part of the plate material placed on a table 14 to the punch position P. The plate material feeding mechanism 13 is composed of a carriage 15 which moves forward and backward (Y direction) and on which a laterally (X direction) moving cross slide 16 is installed. A work holder 17 that grips an end of the plate material W is attached to the cross slide 16.

Machining control means 46 uses a computerized numerical control device or the like to control the whole punch press, for example, the plate material feeding mechanism 13, tool indexing means 45, and punching means 10. The machining control means 46 has post-punching deburring control means 47 which performs predetermined control and which is composed of a machining program. The post-punching deburring control means 47 will be described below in detail.

Figure 3:
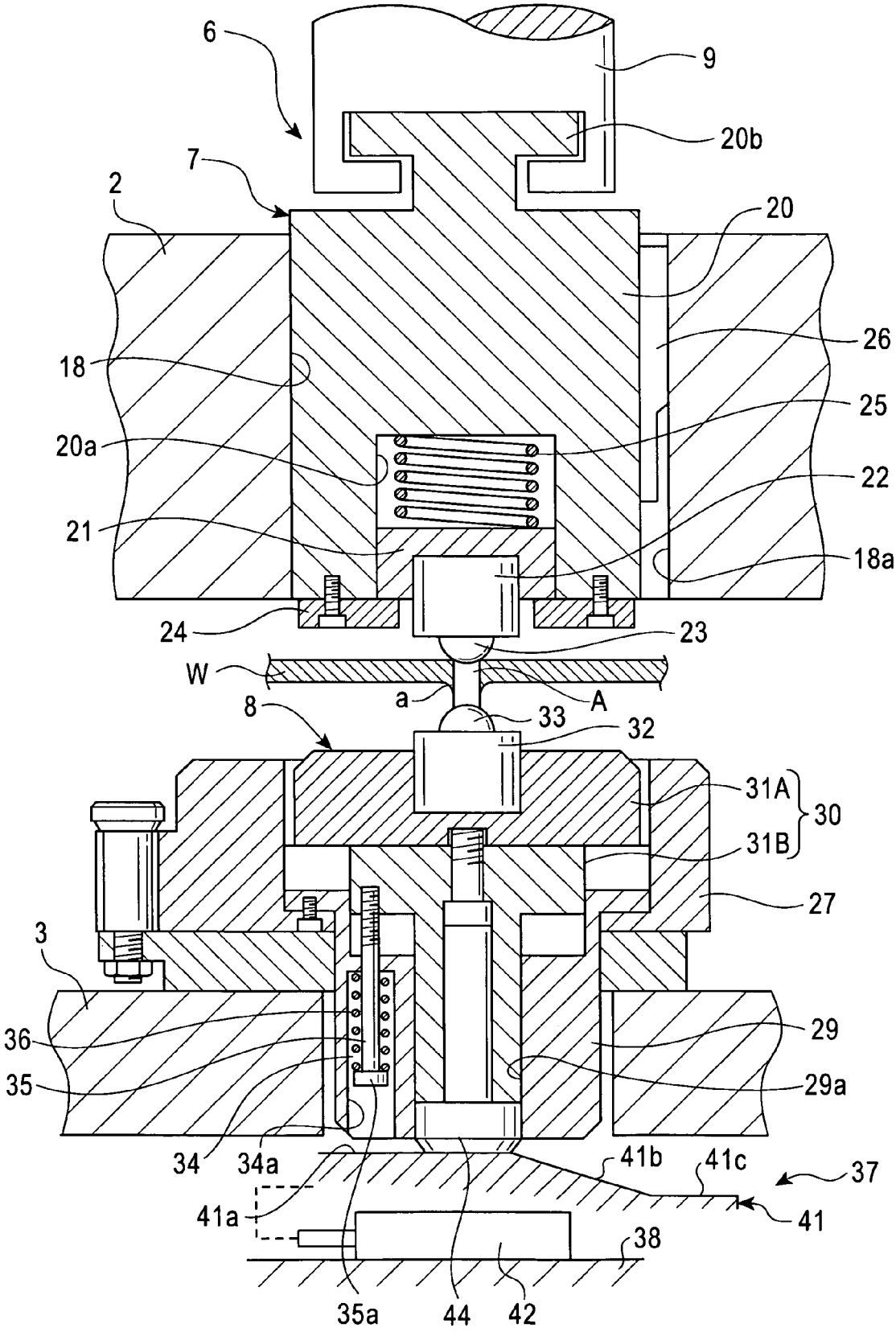
FIG. 3 is a vertical sectional view showing how the deburring device is installed in the punch press.

FIG. 3 is a vertical cross section of the upper tool 7 and lower tool 8 of the deburring device 6 attached to the upper and lower turrets 2, 3. The upper tool 7 and lower tool 8 are used to remove burrs (a) produced along the opening edges of a slot A formed in the plate material W by punching so as to extend across the plane.

Figure 4A:
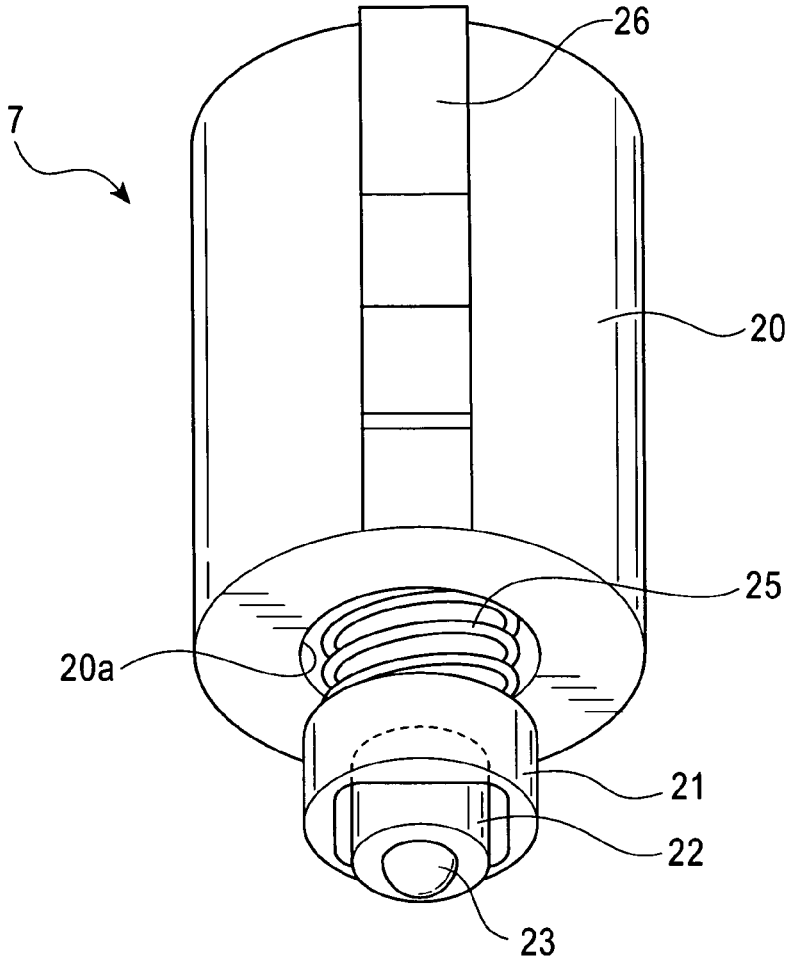
FIG. 4A is a perspective view showing an upper tool of the deburring device.

As shown in the perspective view in FIG. 4A, the upper tool 7 has a cylindrical upper tool main body 20 having a guide hole 20*a* opened in a bottom surface, a guide member 21 inserted into the guide hole 20*a* of the upper tool main body 20 so that the guide member 21 can rise and lower freely, a ball holding member 22 fixed to the guide member 21, and a ball 23 rotatably supported by the ball holding member 22 and projecting downward. The guide member 21 is clamped by a stopper 24 (FIG. 3) provided at a lower end of the upper tool main body 20. The guide member 21 is also urged downward by a coil spring 25 inserted into the guide hole 20*a*. The upper tool 7 is fitted into a tool hole 18 in the upper turret 2 so that the upper tool 7 can rise and lower freely. The upper tool 7 is clamped to the upper turret 2 by engaging a key 26 provided on an outer periphery of the upper tool main body 20, with a key way 18*a* in the tool hole 18. At the punch position P (FIG. 1), the upper tool 7 is connected to the ram 9 via a T-shaped junction 20*b* located at an upper end of the upper tool main body 2.

Figure 4B:
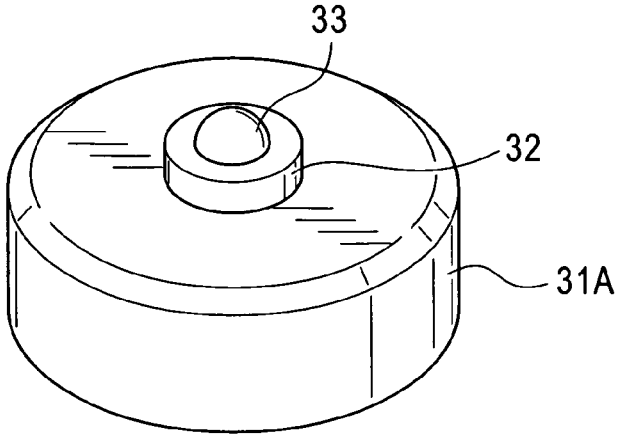
FIG. 4B is a perspective view showing a lower tool main body upper member in a lower tool of the deburring device.
Figure 5A:
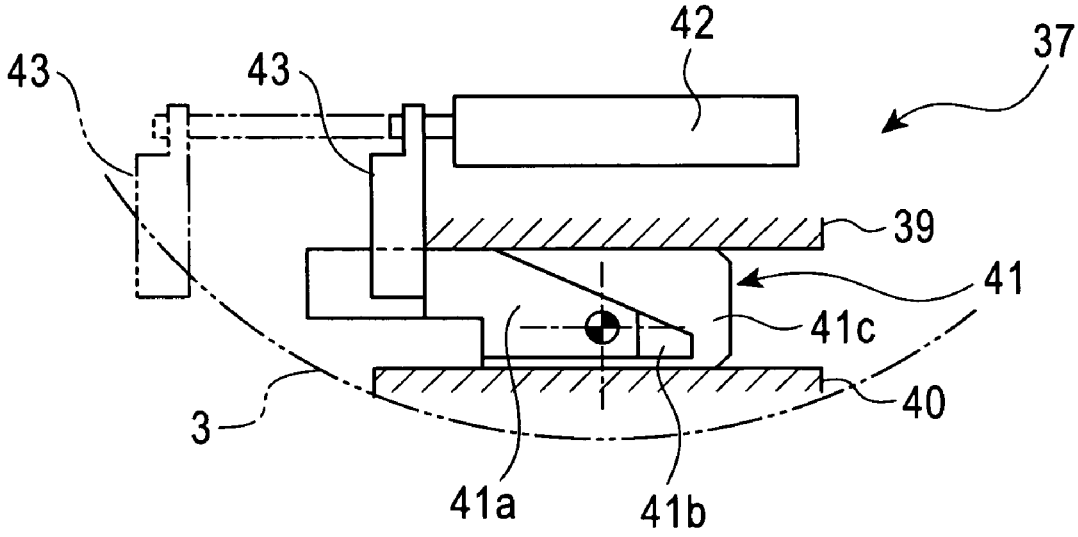
FIG. 5A is a plan view schematically showing the configuration of a lower tool raising and lowering means for raising and lowering the lower tool of the deburring device.
Figure 5B:
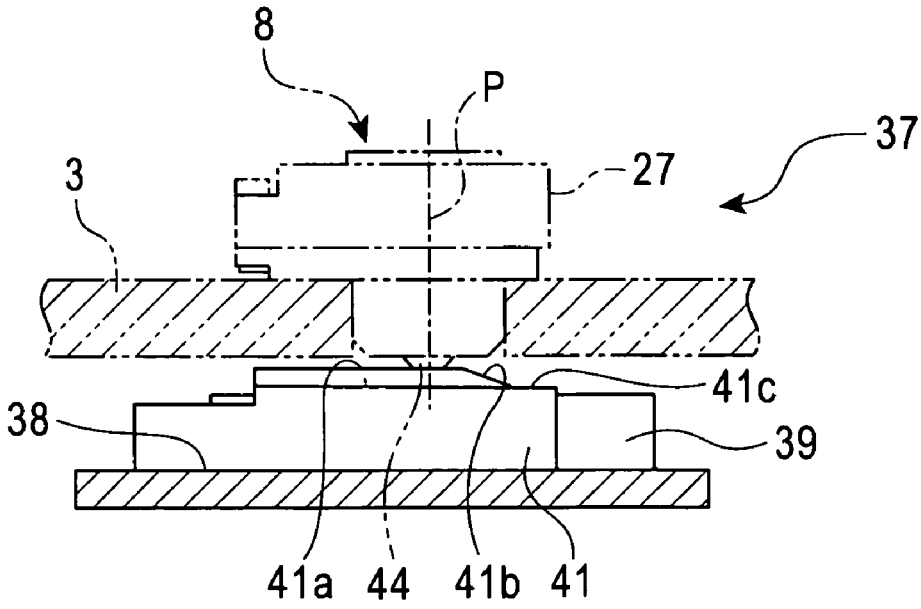
FIG. 5B is a front view schematically showing the configuration of the lower tool raising and lowering means.

In FIG. 3, the lower tool 8 has a lower tool outer case 29 fixed to the lower turret 3 via a lower turret holding table 27, a lower tool main body 30 supported in the lower tool outer case 29 so that the lower tool main body 30 can rise and lower freely, a ball holding member 32 fixed to an upper member 31A of the lower tool main body 30, and a ball 33 rotatably supported by the ball holding member 32 and projecting upward. FIG. 4B is a perspective view of the upper member 31A of the lower tool main body 30.

Each of the balls 23, 33 in the upper and lower tools 7, 8 is placed so as to project from a surface of the corresponding ball holding member 22, 32 toward the opposite surface of the other ball holding member 32, 22. Each of the balls 23, 33 in the upper and lower tools 7, 8 has a diameter larger than the width of the slot A in its portion projecting from the ball holding member 22, 32, respectively, and the slot A is formed in the plate material W by punching and is subjected to deburring. The ball 23 and ball holding member 22 in the upper tool 7 are composed of a free bearing. The ball 23 is partly projectingly provided in a case constituting the ball holding member 22, and the ball 23 is rotatable and is clamped. The ball 33 and ball holding member 32 in the upper tool 8 are composed of a free bearing as in the case of the upper tool 7. The upper and lower free bearings may have the same configuration. The balls 23, 33 are composed of steel.

A lower member 31B of the lower tool main body 30 is fitted into a guide hole 29*a* formed in the lower tool outer case 29 so that the lower member 31B can rise and lower freely. Thus, the lower tool main body 30 is supported so that it can rise and lower freely with respect to the lower tool outer case 29. A bolt 35 is screwed into the lower member 31B of the lower tool main body 30, and the bolt 35 penetrates a bolt through hole 34 formed in the lower tool outer case 29 parallel to the guide hole 29*a*. A coil spring 36 is interposed between a head 35*a* of the bolt 35 and an increased diameter portion 34*a* of the bolt through hole 34 to urge the lower tool main body 30 downward.

Lower tool raising and lowering means 37 is provided below the lower turret 3 at the punch position P to raise the lower tool 8 to a predetermined height. As shown in the plan view and front view in FIGS. 5A and 5B, respectively, the lower tool raising and lowering means 37 is composed of an advancing and retracting member 41 that is guided forward and backward in a direction orthogonal to a radial direction of the lower turret 3 by a pair of guide members 39, 40 on a pressure receiving material 38, and an actuator 42 that drivingly advances and retracts the advancing and retracting member 41. A top surface of the advancing and retracting member 41 has an upper horizontal surface portion 41*a* and a lower horizontal surface portion 41*c*, and an inclined surface portion 41*b* inclining downward from the upper horizontal surface portion 41*a* to the lower horizontal surface portion 41*c*. The actuator 42 is composed of a fluid cylinder and has a piston rod the tip of which is connected to a rear end of the advancing and retracting member 41 using a connecting member 43. A cam follower 44 is slidably contacted with the top surface of the advancing and retracting member 41, and the cam follower 44 is provided at a lower end of the lower member 31B of the lower tool main body 30.

Figure 6:
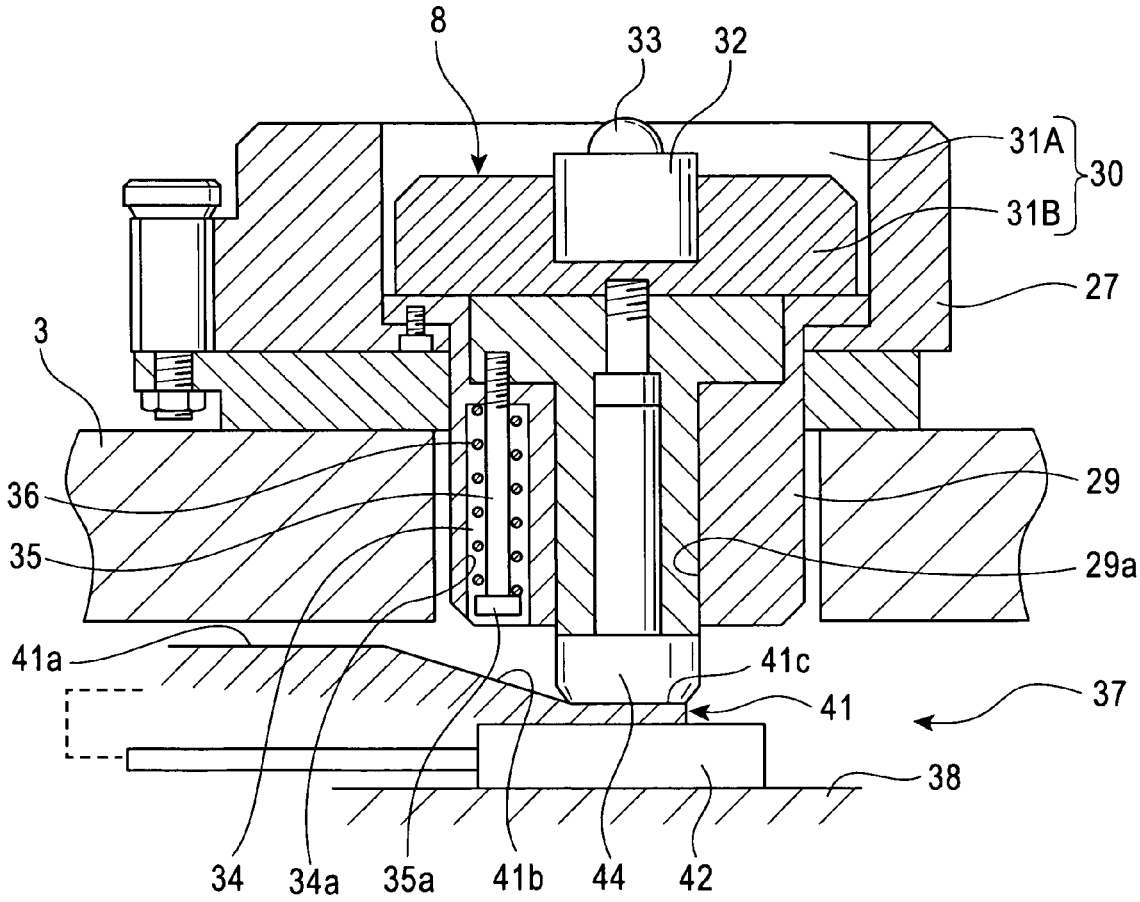
FIG. 6 is a sectional view showing that the lower tool has been lowered using the lower tool raising and lowering means.

When the cam follower 44 is received by the upper horizontal surface portion 41*a* of the advancing and retracting member 41 as shown in FIG. 3, the actuator 42 drivingly advances or retracts the advancing and retracting member 41 to lift the lower tool 8 to a predetermined height required for deburring. Further, the lower tool 8 lowers when the cam follower 44 is received by the lower horizontal surface portion 41*c* of the advancing and retracting member 41 as shown in FIG. 6. Thus, rotation of the lower turret 2 avoids contacting the ball 33 in the lower tool 8 with a bottom surface of the plate material W when the lower tool 8 is located away from the punch position P.

With the punch press configured as described above, if such a slot A as shown in FIG. 7 is formed in the plate material W by punching with the punch tool 4 and die tool 5, the burrs (a) (FIG. 3) produced along the opening edges of the slot A are removed using the same punch press as described below.

Figure 8A:
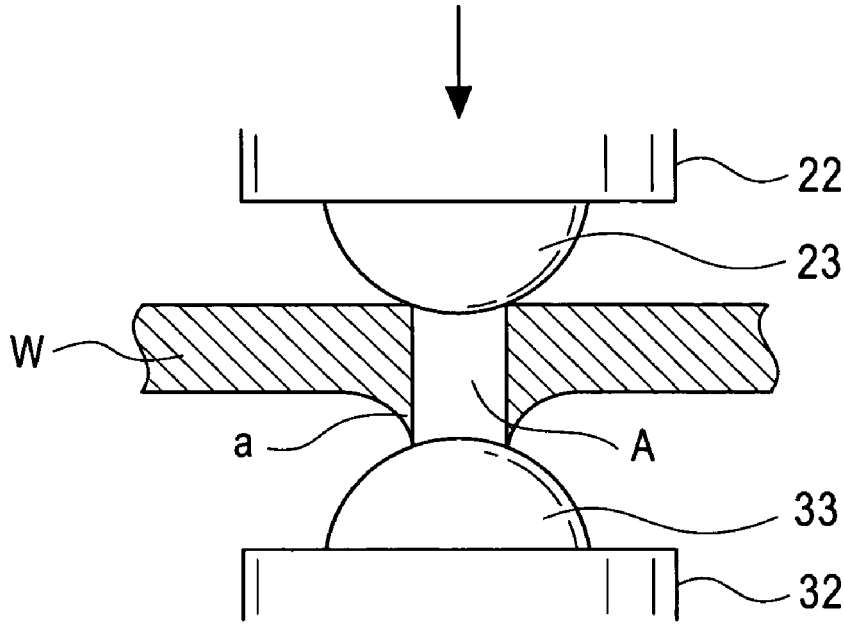
FIG. 8 is a sectional view showing a deburring operation preformed by the deburring device.
Figure 8B:
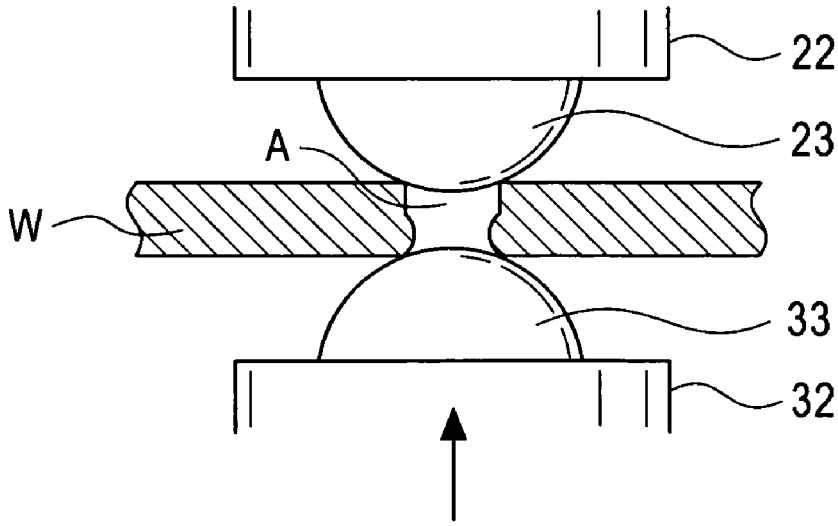

First, the upper and lower turrets 2, 3 are rotatively driven to index the upper and lower tools 7, 8 of the deburring device 6 to the punch position P. Then, the plate material W is moved so that one end of the slot A is located at the punch position A, and the plate material W is gripped by the work holder 17 of the plate material feeding mechanism 13. Then, the ram 9 drives and lowers the upper tool 7 to a predetermined height, while the lower tool raising and lowering means 37 drives and raises the lower tool 8 to a predetermined height. Thus, the plate material W is sandwiched between the upper and lower balls 23, 33 so that the vertical pair of balls 23, 33 is partly fitted into the slot A as shown in FIGS. 8A and 8B. This causes the burrs (a) projecting downward from the plate material W to be plastically deformed to the inside of the slot A. In FIG. 8, the burrs 8 are shown larger than they are actually are for emphasis.

Figure 7:
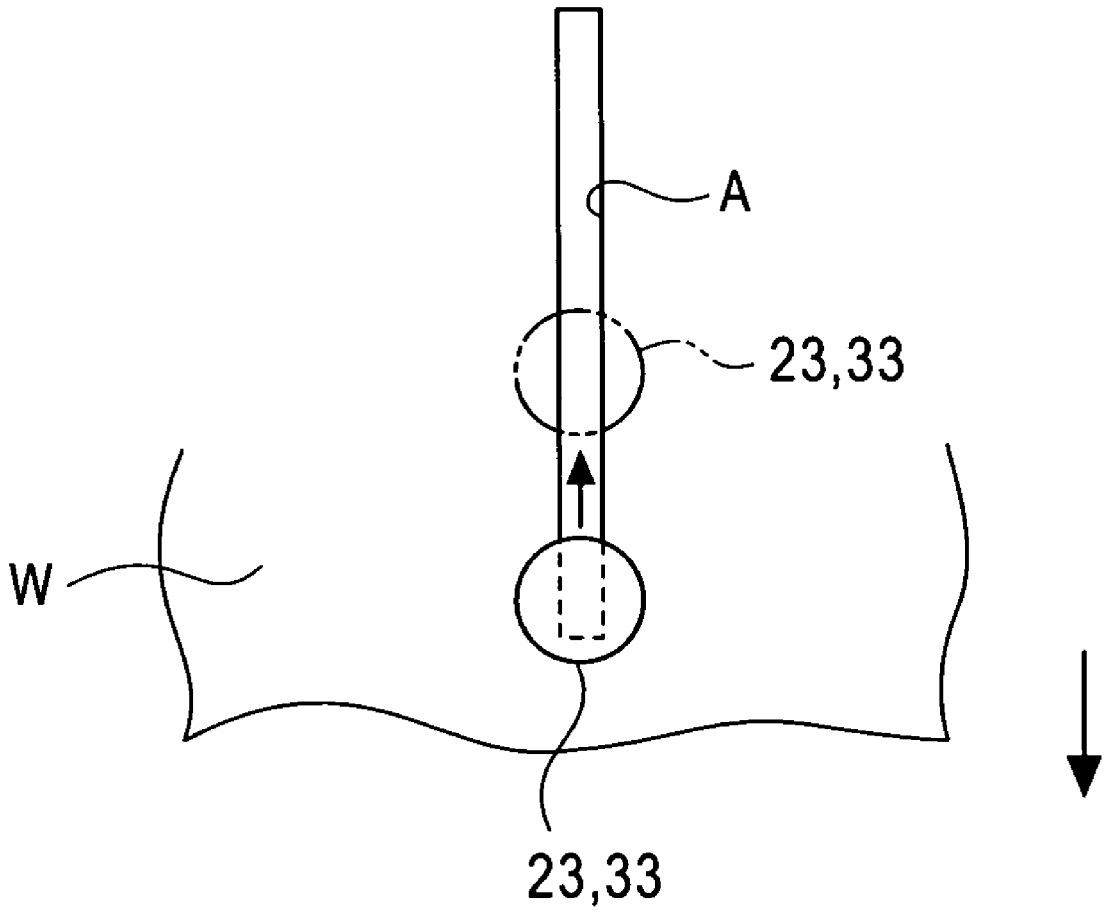
FIG. 7 is a plan view of a deburring operation performed by the deburring device.

In this state, as shown in FIG. 7, the plate material feeding mechanism 13 moves the plate material W so that the balls 23, 33 move relative to each other in a longitudinal direction of the slot A. This makes it possible to continuously and smoothly remove the burrs (a) formed along the longitudinal direction of the slot A. Further, smooth deburring can also be accomplished even if the slot A is formed to have an acute angle. In the deburring operation, the ball 23 in the upper tool 7 is urged downward by the coil spring 25. Consequently, uniform deburring can be accomplished along the longitudinal direction of the slot A regardless of a variation in the thickness of the plate material W.

Plural types of upper and lower tools 7, 8 for the deburring device 6 may be installed on the upper and lower turrets 2, 3, respectively, the upper and lower tools 7, 8 having the upper and lower balls 23, 33 with different ball diameters. Then, by using the upper and lower turrets 2, 3 to index the desired deburring device 6 to the punch position P, it is possible to deburr various slots A with different widths using the same punch press.

As described above, in the deburring device 6 of the punch press, the balls 23, 33 are rotatably provided in the upper and lower tools 7, 8, respectively. Further, the plate material W is moved while being sandwiched between the upper and lower balls 23, 33, to continuously remove the burrs (a) from the slot A. It is thus possible to continuously remove the burrs (a) produced along the slot A formed in the plate material as a result of punching with the punch press so that the removal is carried out as a process with the same punch press and can be smoothly executed even if the slot A is formed to have an acute angle.

The burrs (a) projecting downward from the plate material W are removed by pressing the upper and lower balls 23, 33 against the burrs (a) to plastically deform the burrs (a) to the inside of the slot A. Consequently, the balls 23, 33 can be provided with durability without being damaged.

Figure 9:
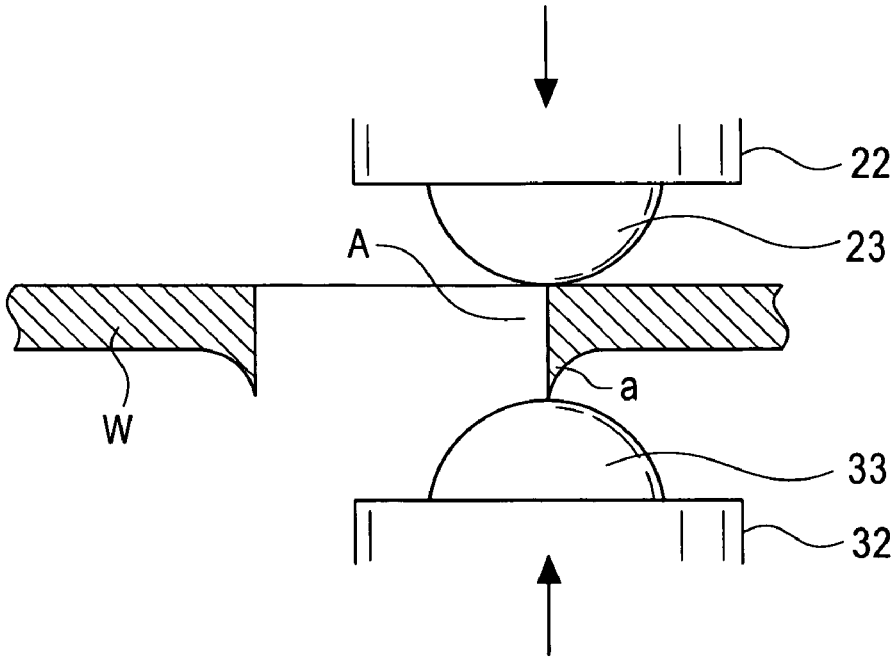
FIG. 9 is a sectional view showing another deburring operation preformed by the deburring device.

The deburring device 6 is used to simultaneously deburr the opposite side edges of the slot A in the plate material W along the longitudinal direction of the slot A. However, as shown in FIG. 9, the deburring device 6 can also be used to deburr the edges of the slot A or an opening that has a width larger than the ball diameter or to remove burrs (a) produced along the machined outer periphery of the plate material W. In this case, while sandwiched between the upper and lower balls 23, 33, the plate material W is moved so that the upper and lower balls 23, 33 roll along its opening edge or outer peripheral edge.

Figure 10:
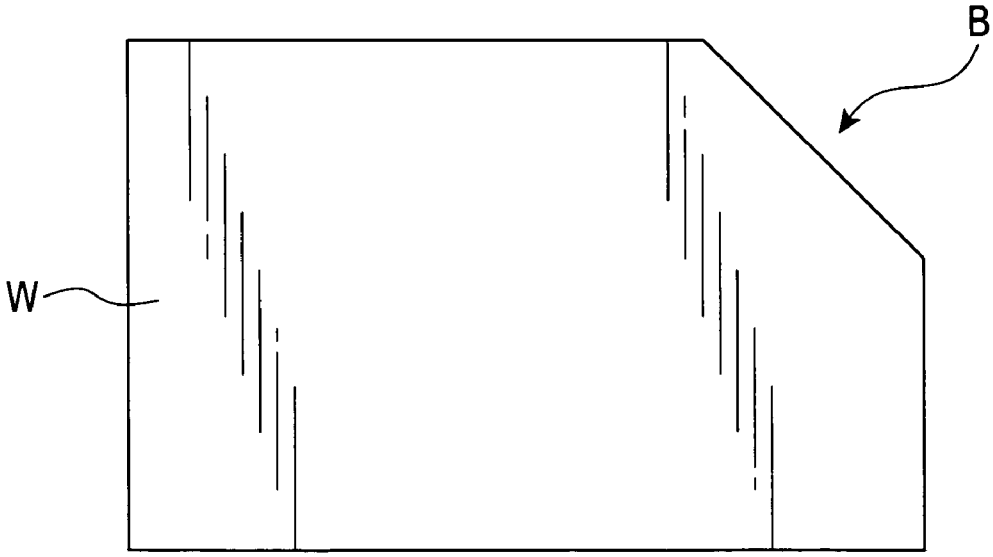
FIG. 10 is a plan view showing another part on which deburring is carried out by the deburring device.

In an example of machining of the outer periphery of the plate material W, for example, the debarring device 6 can be used to continuously remove burrs (a) developed along a cut portion formed in the plate material W as shown in FIG. 10. The cut portion B is formed by a cutting operation based on nibbling or the consecutive formation of punch holes using the punch tool 4 and die tool 5 (FIG. 2).

Figure 11:
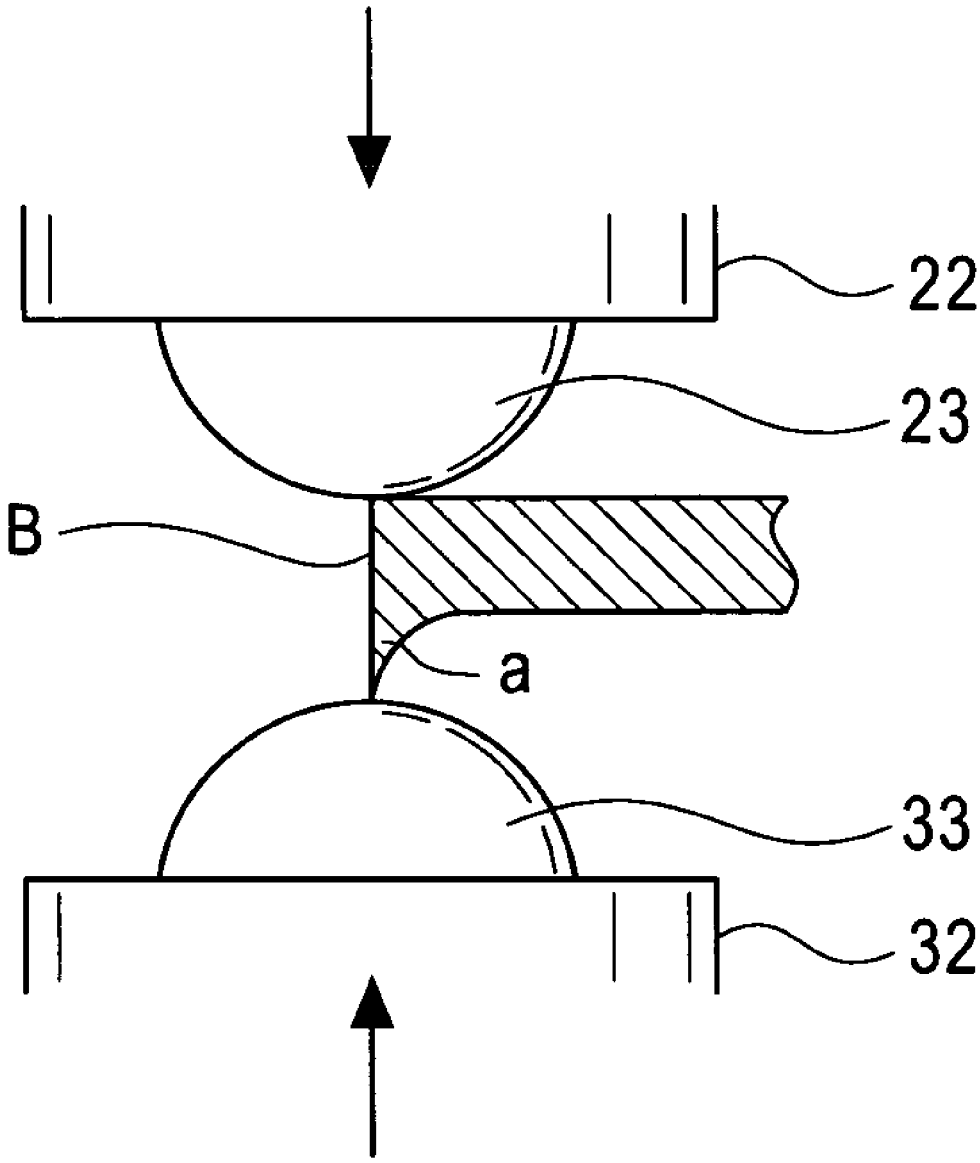
FIG. 11 is a sectional view showing another deburring operation performed by the deburring device.

FIG. 11 shows how the burrs (a) along the cut portion B of the plate material W are removed. While sandwiched between the upper and lower balls 23, 33, the plate material W is moved so that the upper and lower balls 23, 33 roll along the cut portion B. This makes it possible to continuously remove the burrs (a) produced on the cut portion B.

In the above embodiment, the upper and lower tools 7, 8 have the ball holding members 22, 32, respectively, separately from the upper and lower tool main bodies 20, 30. However, the upper and lower tool main bodies 20, 30 may constitute ball holding members.

The post-punching deburring control means 47 in the machining control means 46 in FIG. 2 is a machining program that controls the whole punch press so that the machining of the slot A and the subsequent deburring are carried out as described in the above examples. The post-punching deburring control means 47 performs the control described below. The post-punching deburring control means 47 causes the tool indexing means 45 to index the punch tool 4 and die tool 5 and then uses the punching means 10 to form a slot A in the plate material W which extends across the plane, while using the plate material feeding means 13 to move the plate material W. The post-punching deburring control means 47 then causes the tool indexing means 45 to index the deburring device 6 and uses the plate material feeding means 13 to move the plate material W along the slot A with the plate material W sandwiched between the upper and lower balls 23, 33 using the punching means 10. The post-punching deburring control means 47 thus continuously removes the burrs (a) produced along the opening edges of the slot A formed using the punch tool 4 and die tool 5.

The post-punching deburring control means 47 not only controls the machining of the slot A and the subsequent deburring but also performs control similar to that performed for the machining of the slot A and the subsequent deburring if such a cut portion B as shown in FIG. 10 is formed and if the burrs (a) developed along the cut portion B are subsequently continuously removed.

That is, the post-punching deburring control means 47 causes the tool indexing means 45 to index the punch tool 4 and die tool 5 and then uses the punching means 10 to form a cut portion B in the plate material W, while using the plate material feeding means 13 to move the plate material W. The post-punching deburring control means 47 then causes the tool indexing means 45 to index the deburring device 6 and uses the plate material feeding means 13 to move the plate material W along the cut portion B with the plate material W sandwiched between the upper and lower balls 23, 33 using the punching means 10. The post-punching deburring control means 47 thus continuously removes the burrs (a) produced along the cut portion B formed using the punch tool 4 and die tool 5.

The invention claimed is:

1. A punch press comprising punching means for punching a plate material, a plate material feeding mechanism which feeds the plate material to a punch position in the punching means, an upper tool support on which a plurality of upper tools are installed, a lower tool support on which a plurality of lower tools corresponding to the upper tools are installed, tool indexing means for indexing the upper and lower tools on the upper and lower tool supports to the punch position in the punching means, and machining control means for controlling the punching means, plate material feeding mechanism, and tool indexing means, the punch press being characterized in that at least one of the upper tools and at least one of the lower tools are a punch tool and a die tool used to form a hole in the plate material, at least one other upper tool and at least one other lower tool are an upper and lower tools for a deburring device, the upper and lower tools each having a ball holding member and a ball rotatably supported by the ball holding member and projecting from a surface of the ball holding member toward an opposite surface of the opposite ball holding member, the machining control means using the tool indexing means to index the punch tool and die tool, using the punching means to form a slot in the plate material which extends across a plane, while using the plate material feeding means to move the plate material, then using the tool indexing means to index the deburring device, and using the plate material feeding means to move the plate material sandwiched between the upper and lower balls using the punching means, to continuously remove burrs produced along a cut portion formed by the punch tool and die tool.

2. The punch press according to claim 1, characterized in that burrs projecting downward from the plate material are removed by pressing the balls against the burrs to plastically deform the burrs.

3. The punch press according to claim 1, characterized in that the burrs are produced along a longitudinal direction of a slot formed in the plate material.

4. The punch press according to claim 3, characterized in that each of the upper and lower balls has a diameter larger than the width of the slot, in it s portion projecting from the ball holding member, and the plate material moves with the vertical pair of balls partly fitted into the slot and with the plate material sandwiched between the upper and lower balls to continuously remove burrs produced at opposite side edges of the slot along the longitudinal direction of the slot.

* * * * *